US010137700B2

(12) United States Patent
Ito et al.

(10) Patent No.: US 10,137,700 B2
(45) Date of Patent: Nov. 27, 2018

(54) INK-JET RECORDING APPARATUS

(71) Applicant: BROTHER KOGYO KABUSHIKI KAISHA, Nagoya-shi, Aichi-ken (JP)

(72) Inventors: Tsuyoshi Ito, Nagoya (JP); Iwane Sano, Obu (JP); Gakuro Kanazawa, Toyokawa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/718,423

(22) Filed: Sep. 28, 2017

(65) Prior Publication Data

US 2018/0093515 A1 Apr. 5, 2018

(30) Foreign Application Priority Data

Sep. 30, 2016 (JP) ..... 2016-194608

(51) Int. Cl.

| | |
|---|---|
| ***B41J 13/00*** | (2006.01) |
| ***B41J 2/21*** | (2006.01) |
| ***B41J 13/02*** | (2006.01) |
| ***B41J 29/393*** | (2006.01) |
| ***B41J 2/14*** | (2006.01) |
| ***B41J 2/165*** | (2006.01) |
| ***B41J 29/38*** | (2006.01) |

(52) U.S. Cl.

CPC ..... *B41J 2/2132* (2013.01); *B41J 2/14* (2013.01); *B41J 2/165* (2013.01); *B41J 13/0027* (2013.01); *B41J 13/02* (2013.01); *B41J 29/38* (2013.01); *B41J 29/393* (2013.01)

(58) Field of Classification Search

CPC ..... B41J 13/102; B41J 2/2132; B41J 13/0027

See application file for complete search history.

(56) References Cited

U.S. PATENT DOCUMENTS 6,155,668 A * 12/2000 Otsuki ..... B41J 2/2128 347/41

FOREIGN PATENT DOCUMENTS

JP 2006-159564 A 6/2006

* cited by examiner

*Primary Examiner* — Julian Huffman

(74) *Attorney, Agent, or Firm* — Merchangt & Gould P.C.

(57) ABSTRACT

An ink-jet recording apparatus configured to record an image based on image data on a sheet, the ink-jet recording apparatus includes a first roller pair, a second roller pair, a carriage, a recording head, and a controller configured to: control the first roller pair and the second roller pair to perform intermittent conveyance of the sheet; control the carriage and the recording head to record a one-pass image on the sheet; and calculate an overlap amount, in the conveyance direction, of a one-pass image to be recorded on the sheet in a predefined one pass and a one-pass image to be recorded on the sheet in a next one pass after the predefined one pass.

13 Claims, 14 Drawing Sheets

Fig. 10

| NIPPING STATE | DISTRIBUTION PROPORTION(%) |
|---|---|
| FIRST STATE | K1 |
| SECOND STATE | K2 |
| THIRD STATE | K3 |

INK-JET RECORDING APPARATUS

CROSS REFERENCE TO RELATED APPLICATION

The present application claims priority from Japanese Patent Application No. 2016-194608 filed on Sep. 30, 2016, the disclosure of which is incorporated herein by reference in its entirety.

BACKGROUND

Field of the Invention

The present invention relates to an ink-jet recording apparatus that records an image on a sheet by jetting ink droplets from nozzles.

Description of the Related Art

For the purpose of improving image recording speed, an ink-jet recording apparatus records an image on a sheet by repeatedly performing a recording operation, in which an image corresponding to one pass (one-pass image) is recorded in a predefined area of the sheet by one scanning (one pass) of a recording head, while changing its area in a conveyance direction.

In such an ink-jet apparatus repeatedly performing the one-pass image recording, the variation in a conveyance amount of the sheet may separate edges of one-pass images recorded in respective passes, resulting in a white streak or stripe formed therebetween.

In order to solve that problem, an ink-jet recording apparatus disclosed in Japanese Patent Application Laid-open No. 2006-159564 performs image recording such that the edges of the one-pass images recorded in respective passes overlap each other. This prevents a separation of edges of one-pass images recorded in respective passes, even when the conveyance amount of the sheet varies.

The variation in the conveyance amount of the sheet depends on the position of the sheet relative to the recording head. For example, when an image is recorded in a center of the sheet in the conveyance direction, the center of the sheet in the conveyance direction faces the recording head with front and rear ends of the sheet in the conveyance direction being nipped by a roller pair conveying the sheet. In that case, the variation in the conveyance amount of the sheet is small. When an image is recorded on the front end or the rear end of the sheet in the conveyance direction, the front end or the rear end faces the recording head and thus it is not nipped by the roller pair. In that case, the sheet conveyance is unstable, increasing the variation in the conveyance amount of the sheet.

In the ink-jet recording apparatus disclosed in Japanese Patent Application Laid-open No. 2006-159564, overlap amounts of the one-pass images recorded in the respective passes are uniform. Thus, when the variation in the conveyance amount of the sheet is small, the edges of the one-pass images recorded in respective passes overlap each other properly. However, when the variation in the conveyance amount of the sheet is large, the edges of the one-pass images recorded in respective passes are liable to be separated from each other.

Further, Japanese Patent Application Laid-open No. 2006-159564 describes that, when the ink-jet recording apparatus disclosed therein forms an image on a sheet by sequentially scanning the recording head to jet ink droplets therefrom, there may be a nozzle that is not used for the last scanning. First, a width of the nozzle that is not used for the last scanning is calculated based on a length of an image recordable area of the sheet and a length of a nozzle area of the recording head. Then, the calculated nozzle width is distributed to a boundary between the one-pass images formed in the respective passes so that the edges of the one-pass images recorded in respective passes overlap each other. However, when the width of the nozzle that is not used for the last scanning is small, the calculated nozzle width can not be distributed uniformly to all the boundaries between the one-pass images formed in the respective passes. In that case, increasing the number of passes by one allows the distribution, to each of the boundaries, of a nozzle width to which a width corresponding to one pass has been added. Increasing the number of passes by one, however, decreases the speed of image recording on the sheet.

The present teaching has been made in view of the above circumstances, and an object of the present teaching is to provide an ink-jet recording apparatus that reduces occurrence of a white streak or stripe during image recording on a sheet.

SUMMARY OF THE INVENTION

According to an aspect of the present teaching, there is provided an ink-jet recording apparatus configured to record an image based on image data on a sheet, the ink-jet recording apparatus including:

- a first roller pair configured to convey the sheet in a conveyance direction while nipping the sheet;
- a recording head disposed downstream of the first roller pair in the conveyance direction, having a nozzle surface in which nozzles are formed in a nozzle area, and configured to jet ink droplets from the nozzles to the sheet;
- a carriage carrying the recording head and configured to move in a width direction intersecting with the conveyance direction;
- a second roller pair disposed downstream of the recording head in the conveyance direction and configured to convey the sheet in the conveyance direction while nipping the sheet; and
- a controller configured to:
  - control the first roller pair and the second roller pair to perform intermittent conveyance of the sheet;
  - control the carriage and the recording head to record a one-pass image on the sheet by causing the recording head to jet the ink droplets during movement of the carriage in the width direction in a state where the sheet is stopped in the intermittent conveyance of the sheet; and
  - calculate an overlap amount, in the conveyance direction, of a one-pass image to be recorded on the sheet in a predefined one pass and a one-pass image to be recorded on the sheet in a next one pass after the predefined one pass, the overlap amount depending on a nipping state of the sheet by the first roller pair and the second roller pair in a case of recording the one-pass image in the next one pass,
- wherein the controller is configured to calculate the overlap amount based on a length of the nozzle area in the conveyance direction and a length in the conveyance direction of the image which corresponds to the image data and which is to be recorded on the sheet.

BRIEF DESCRIPTION OF THE DRAWINGS

FIG. 3 depicts a lower surface (a nozzle surface) of the recording head.

FIG. 10 is a data table stored in a ROM or an EEPROM.

DESCRIPTION OF THE EMBODIMENTS

Figure 1:
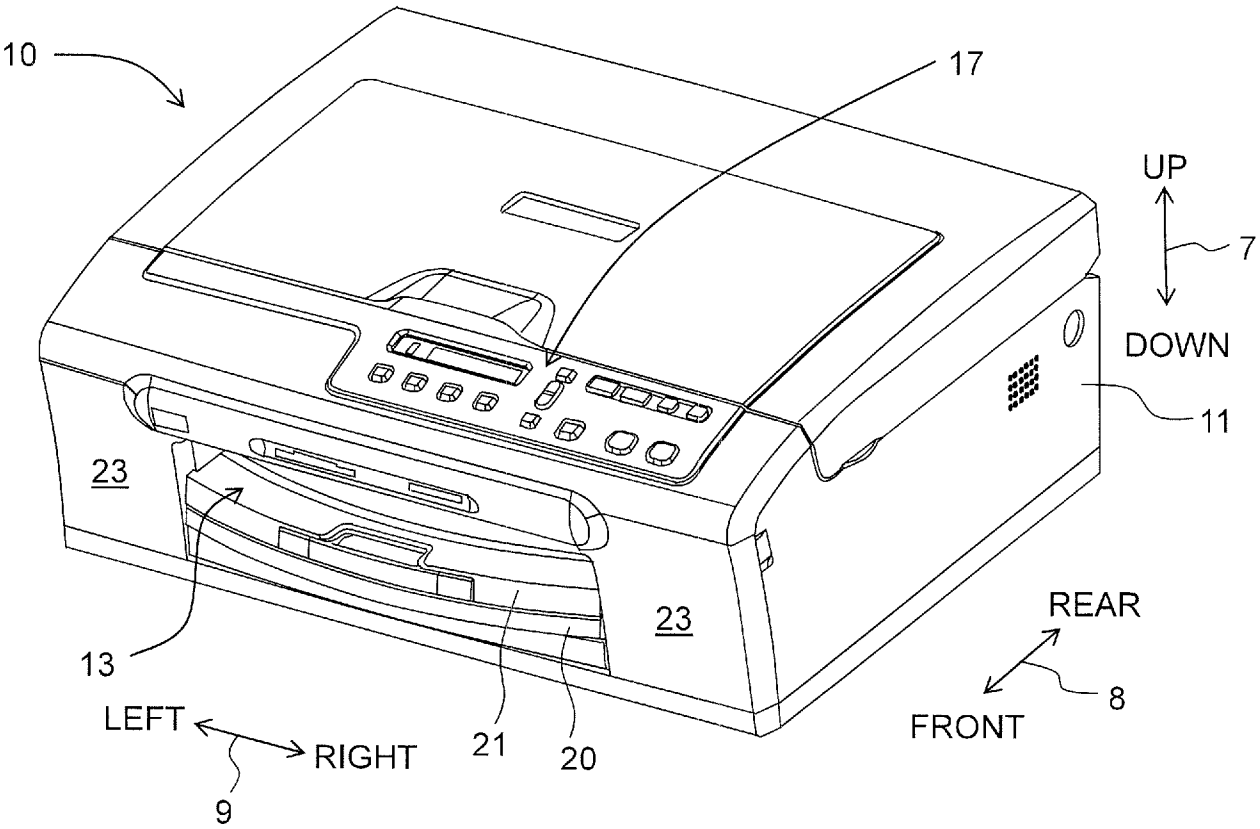
FIG. 1 is a perspective view of a multifunction peripheral according to an embodiment of the present teaching.

An embodiment of the present teaching will be described below. Note that, the embodiment described below is merely an example of the present teaching; it goes without saying that it is possible to make any appropriate change(s) in the embodiment of the present teaching without departing from the gist and/or scope of the present teaching. In the following explanation, an up-down direction 7 is defined on the basis of the state in which a multifunction peripheral 10 is placed to be usable (the state depicted in FIG. 1). A front-rear direction 8 is defined as a front surface 23 of the multifunction peripheral 10 formed with an opening 13 is provided on the front side. A left-right direction 9 is defined as the multifunction peripheral 10 is seen from the front side. The up-down direction 7 is perpendicular to the front-rear direction 8 and the left-right direction 9, and the front-rear direction 8 is orthogonal to the left-right direction 9.

<Overall Configuration of Multifunction Peripheral 10>

As depicted in FIG. 1, the multifunction peripheral 10 (an exemplary ink-jet recording apparatus) has a substantially thin rectangular parallelepiped shape. A lower portion of the multifunction peripheral 10 is provided with a printing unit 11. The multifunction peripheral 10 has various functions such as a facsimile function and a print function. The multifunction peripheral 10 has, as the print function, a function for recording an image on a surface of a sheet 12 (see FIG. 2, an exemplary sheet) in accordance with an ink-jet system. The multifunction peripheral 10 may record images on both surfaces of the sheet 12. An operation unit 17 is disposed in an upper portion of the printing unit 11. The operation unit 17 is configured by buttons for inputting a print instruction and various settings, a liquid crystal display on which a variety of information is displayed, and the like.

<Feed Tray 20>

Figure 2:
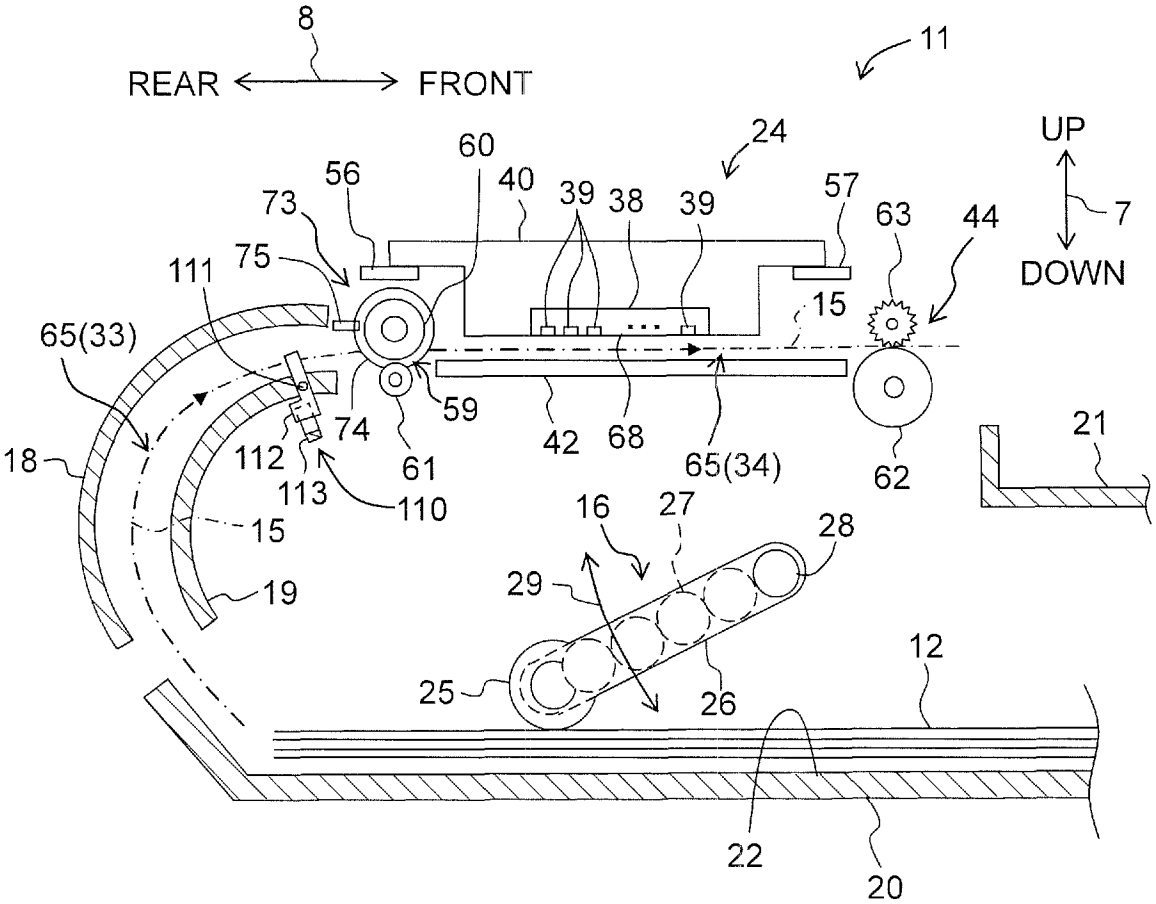
FIG. 2 is a vertical cross-sectional view schematically depicting an internal structure of a printing unit.

As depicted in FIG. 1, the opening 13 is provided on the front side of the print unit 11. The feed tray 20 moving in the front-rear direction 8 can be inserted into or removed from the printing unit 11 through the opening 13. The feed tray 20 is a box-like member of which upper portion is open. As depicted in FIG. 2, a bottom plate 22 of the feed tray 20 supports stacked sheets 12. A discharge tray 21 is disposed at an upper front portion of the feed tray 20. The sheet 12 for which an image has been recorded by the recording unit 24 is discharged on an upper surface of the discharge tray 21 and supported thereby.

<Feed Unit 16>

As depicted in FIG. 2, the feed unit 16 is disposed below the recording unit 24. The feed unit 16 includes a feed roller 25, a feed arm 26, a driving transmission mechanism 27, and a shaft 28. The feed roller 25 is rotatably supported by a front end of the feed arm 26. The feed arm 26 pivots around the shaft 28, which is disposed at its base end, in directions indicated by an arrow 29. This allows the feed roller 25 to make contact with or separate from the feed tray 20 or the sheet 12 supported by the feed tray 20.

The feed roller 25 rotates when receiving driving force of a feed motor 102 (see FIG. 4) transmitted by the driving transmission mechanism 27 configured by engaged gears. This feeds the uppermost sheet 12, of the sheets 12 supported by the bottom plate 22 of the feed tray 20, which is in contact with the feed roller 25 to a conveyance path 65. The driving transmission mechanism 27 is not limited to that configured by the engaged gears, and it may be, for example, a belt stretched between the shaft 28 and a shaft of the feed roller 25.

<Conveyance Path 65>

As depicted in FIG. 2, the conveyance path 65 extends from a rear end of the feed tray 20. The conveyance path 65 includes a curved part 33 and a straight-line part 34. The curved part 33 extends upward and frontward to make a U-turn. The straight-line part 34 extends substantially in the front-rear direction 8.

The curved part 33 is configured by an outer guide member 18 and an inner guide member 19 facing each other at a predefined interval. Each of the guide members 18 and 19 extends in the left-right direction 9 (an exemplary width direction) that is perpendicular to the paper surface of FIG. 2. In a position where the recording unit 24 is arranged, the straight-line part 34 is configured by the recording unit 24 and the platen 42 facing each other at a predefined interval.

The sheet 12 supported by the feed tray 20 is conveyed through the curved part 33 by use of the feed roller 25 to reach a conveyance roller pair 59 described later. The sheet 12 nipped by the conveyance roller pair 59 is conveyed frontward through the straight-line part 34 to reach the recording unit 24. The recording unit 24 records an image on the sheet 12 positioned immediately below the recording unit 24. The sheet 12 having the image recorded thereon is conveyed frontward through the straight-line part 34 and then discharged on the discharged tray 21. Accordingly, the sheet 12 is conveyed in the conveyance direction 15 indicated by a dot-dash chain line arrow in FIG. 2.

<Recording Unit 24>

As depicted in FIG. 2, the recording unit 24 is disposed above the straight-line part 34. The recording unit 24 includes a carriage 40 and a recording head 38.

The carriage 40 is movably supported in the left-right direction 9 orthogonal to the conveyance direction 15 by use of two guide rails 56 and 57 arranged in the front-rear direction 8 at an interval. The movement direction of the carriage 40 is not limited to the left-right direction 9, and it may be any direction intersecting with the conveyance direction 15. The guide rail 56 is disposed upstream of the recording head 38 in the conveyance direction 15. The guide rail 57 is disposed downstream of the recording head 38 in the conveyance direction 15. The guide rails 56 and 57 are supported by side frames (not depicted) arranged outside the straight-line part 34 of the conveyance path 65 in the left-right direction 9. The carriage 40 moves when receiving driving force of a carriage driving motor 103 (see FIG. 4).

The recording head 38 is carried on the carriage 40. The recording head 38 includes nozzles 39 arranged on a lower surface (a nozzle surface) 68 and piezoelectric elements 45 (see FIG. 4). Each piezoelectric element 45 causes a part of an ink channel formed in the recording head 38 to be deformed so that ink droplets are jetted from each nozzle 39. The piezoelectric elements 45 are activated by electric power supplied from a controller 130 (see FIG. 4), as described later.

Figure 3:
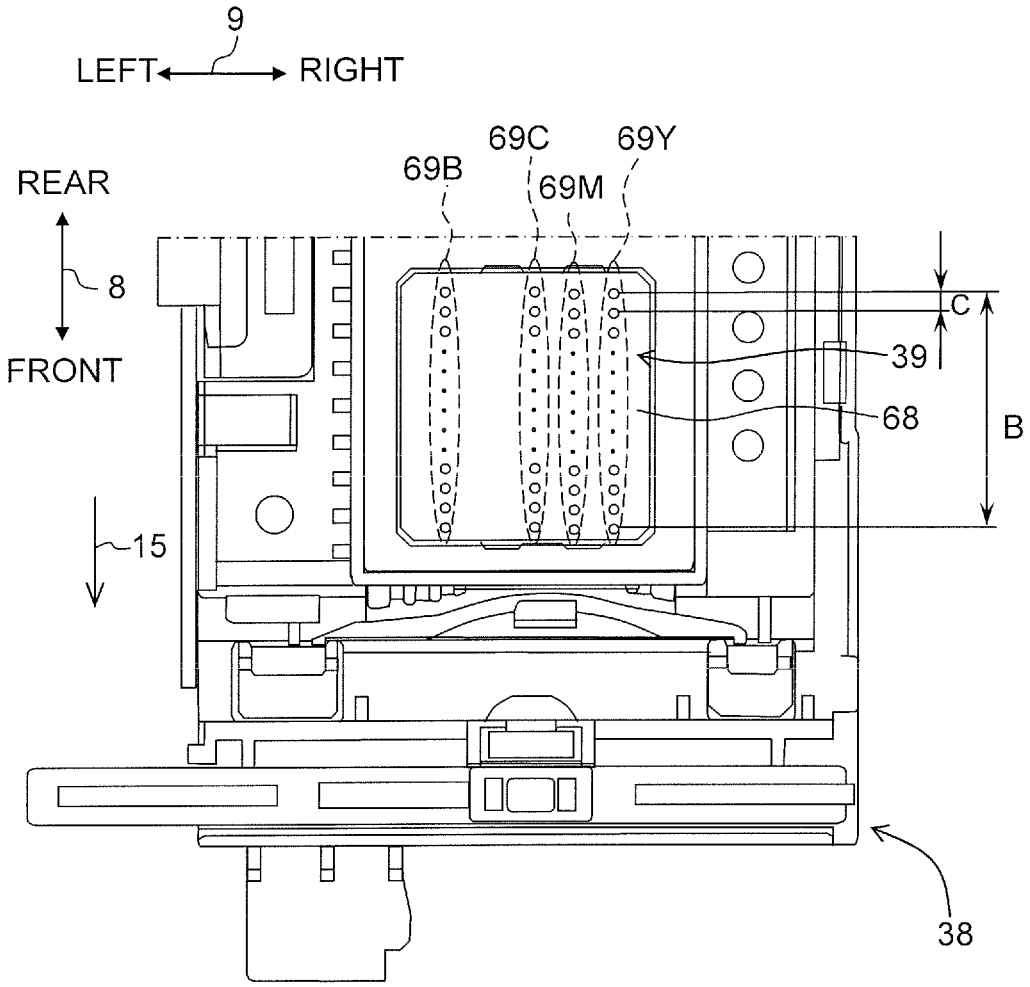
FIG. 3 is a bottom view of a recording head, namely.

As depicted in FIG. 3, the lower surface (nozzle surface) 68 is formed with nozzle rows 69C, 69M, 69Y, and 69B. Each of the nozzle rows 69C, 69M, 69Y, and 69B is configured by the nozzles 39 arranged in the conveyance direction 15. The nozzle rows 69C, 69M, 69Y, and 69B are arranged in the left-right direction 9 at intervals. The area including the nozzles 39 is a nozzle area.

As depicted in FIG. 2, the platen 42 is disposed below the straight-line part 34 at a position facing the recording head 38. The platen 42 supports the sheet 12 conveyed through the straight-line part 34 of the conveyance path 65 in the conveyance direction 15.

Figure 4:
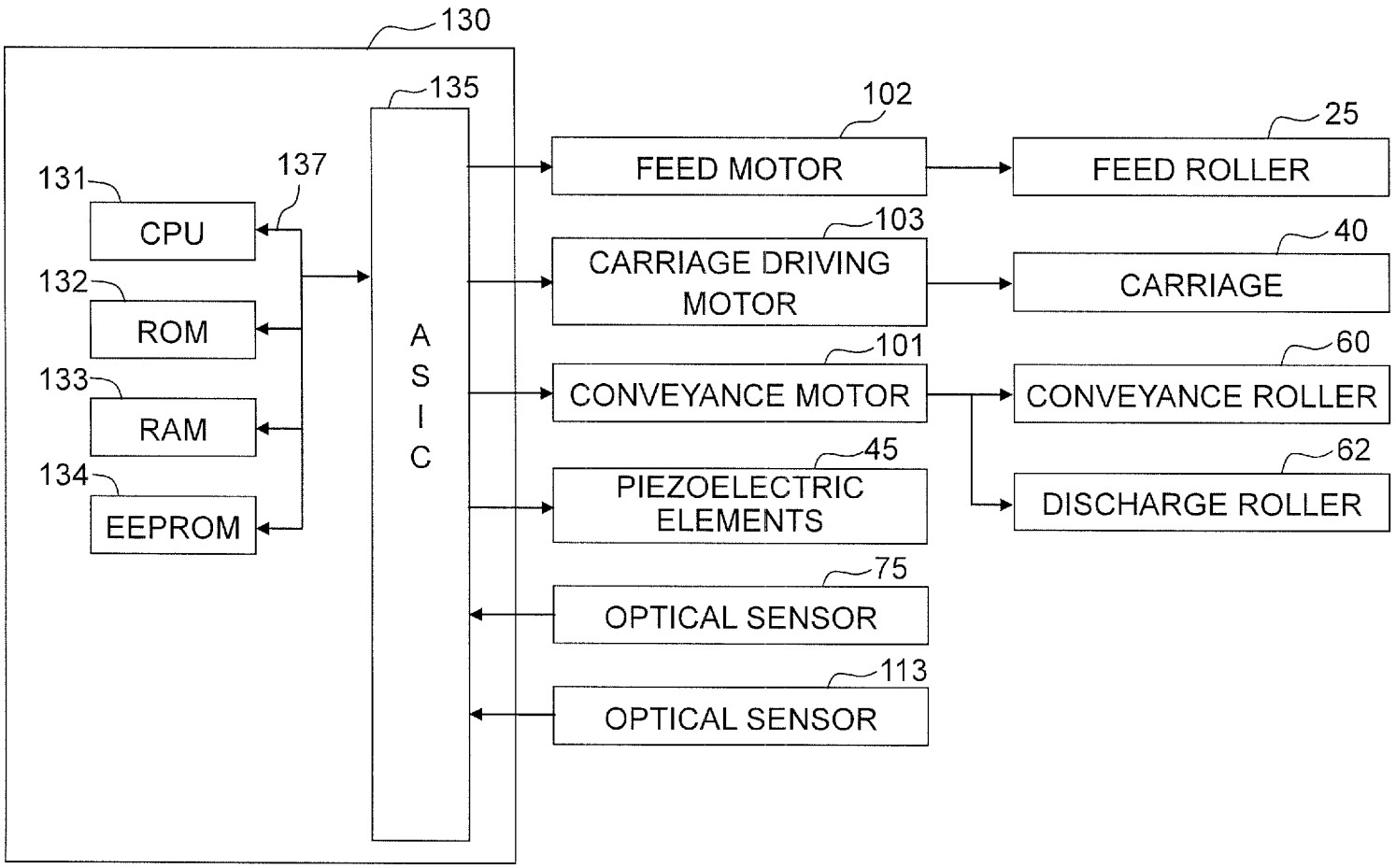
FIG. 4 is a block diagram of a configuration of a controller.

The recording unit 24 is controlled by the controller 130 (see FIG. 4). During the movement of the carriage 40 in the left-right direction 9, the recording head 38 jets ink droplets from each nozzle 39 toward the platen 42, specifically, the sheet 12 supported by the platen 42. Accordingly, an image is recorded on the sheet 12 supported by the platen 42 and conveyed through the straight-line part 34 in the conveyance direction 15.

<Conveyance Roller Pair 59 and Discharge Roller Pair 44>

As depicted in FIG. 2, the straight-line part 34 is provided with the conveyance roller pair 59 (an exemplary first roller pair) at a position upstream of the recording head 38 and the platen 42 in the conveyance direction 15. The straight-line part 34 is provided with a discharge roller pair 44 (an exemplary second roller pair) at a position downstream of the recording head 38 and the platen 42 in the conveyance direction 15.

The conveyance roller pair 59 includes a conveyance roller 60 and a pinch roller 61, which is disposed below the conveyance roller 60 to face the conveyance roller 60. The pinch roller 61 is pressed toward the conveyance roller 60 by use of an elastic member (not depicted) such as a coil spring. The conveyance roller pair 59 can nip the sheet 12.

The discharge roller pair 44 includes a discharge roller 62 and a spur roller 63, which is disposed above the discharge roller 62 to face the discharge roller 62. The spur roller 63 is pressed toward the discharge roller 62 by use of an elastic member (not depicted) such as a coil spring. The discharge roller pair 44 can nip the sheet 12.

The conveyance roller 60 and the discharge roller 62 rotate when receiving driving force from a conveyance motor 101 (see FIG. 4). The sheet 12 in a state of being nipped by the conveyance roller pair 59 is conveyed in the conveyance direction 15 due to the rotation of the conveyance roller 60, reaching the platen 42. The sheet 12 in a state of being nipped by the discharge roller pair 44 is conveyed in the conveyance direction 15 due to the rotation of the discharge roller 62, and then the sheet 12 is discharged on the discharge tray 21.

<Detection Unit 110>

As depicted in FIG. 2, the conveyance path 65 is provided with a detection unit 110 at a position upstream of the conveyance roller pair 59 in the conveyance direction 15. The detection unit 110 includes a shaft 111, a detecting element 112 that can pivot around the shaft 111, and an optical sensor 113 that includes a light emitting element and a light receiving element that receives the light emitted from the light emitting element.

A first end of the detecting element 112 protrudes into the conveyance path 65. When no external force is applied to the first end of the detecting element 112, a second end of the detecting element 112 enters an optical path ranging from the light emitting element of the optical sensor 113 to the light receiving element to block the light passing through the optical path. In that situation, the optical sensor 113 outputs a low-level signal to the controller 130 (see FIG. 4).

When the first end of the detecting element 112 is pushed by a front end of the sheet 12 to pivot, the second end of the detecting element 112 leaves the optical path to allow the light to pass therethrough. In that situation, the optical sensor 113 outputs a high-level signal to the controller 130. The controller 130 detects a downstream end of the sheet 12 in the conveyance direction 15 (the front end of the sheet 12) and an upstream end of the sheet 12 in the conveyance direction 15 (a rear end of the sheet 12) based on the signals from the optical sensor 113.

<Rotary Encoder 73>

As depicted in FIG. 2, the conveyance roller 60 is provided with a rotary encoder 73 that detects a rotation amount of the conveyance roller 60. The rotary encoder 73 is configured by an encoder disk 74 that is provided in a shaft of the conveyance roller 60 to rotate together with the conveyance roller 60 and an optical sensor 75. The encoder disk 74 is formed with a pattern in which transmissive parts transmitting light and non-transmissive parts transmitting no light are arranged alternately at regular pitches in a circumferential direction. During the rotation of the encoder disk 74, a pulse signal is generated every time the optical sensor 75 detects the transmissive part or the non-transmissive part. The generated pulse signal is outputted to the controller 130 (see FIG. 4). The controller 130 calculates the rotation amount of the conveyance roller 60 based on the pulse signal.

<Controller 130>

Referring to FIG. 4, a schematic configuration of the controller 130 will be explained. The present teaching is achieved by causing the controller 130 to perform recording control in accordance with a flowchart described later. The controller 130 controls the whole operation of the multi-function peripheral 10. The controller 130 includes a CPU 131, a ROM 132, a RAM 133, an EEPROM 134, an ASIC 135, and an internal bus 137 connecting the above components with each other.

The ROM 132 stores programs and the like to allow the CPU 131 to control various operations including the recording control. The RAM 133 is used as a storage area temporarily recording data, signals, and the like which are used when the CPU 131 executes the above programs. The EEPROM 134 stores settings, flags, and the like which should be retained even after the power is turned off.

The ASIC 135 is connected to the conveyance motor 101, the feed motor 102, and the carriage driving motor 103. The ASIC 135 incorporates drive circuits controlling the respective motors. When the driving signal for rotating each motor is inputted from the CPU 131 to the corresponding drive circuit, the driving current corresponding to each driving signal is outputted from the drive circuit to the corresponding motor. This rotates the corresponding motor. Namely, the controller 130 controls the motors 101, 102, and 103.

The pulse signal outputted from the optical sensor 75 is inputted to the ASIC 135. The controller 130 calculates the rotation amount of the conveyance roller 60 based on the pulse signal from the optical sensor 75. The controller 130 calculates the conveyance amount of the sheet 12 based on the rotation amount of the conveyance roller 60. The optical sensor 113 is connected to the ASIC 135. The controller 130 detects the front end and the rear end of the sheet 12 at the arrangement position of the detection unit 110 based on the signals from the optical sensor 113. The controller 130 recognizes the position of the sheet 12 conveyed through the conveyance path 65 based on the conveyance mount of the sheet 12 and the timing at which the detection unit 110 has detected the front or rear end of the sheet 12.

The piezoelectric elements 45 are connected to the ASIC 135. Each piezoelectric element 45 is activated by the electric power supplied from the controller 130 via an unillustrated drive circuit. The controller 130 controls the power feeding to the piezoelectric elements 45 so that ink droplets are selectively jetted from the nozzles 39 of the nozzle rows 69C, 69M, 69Y, and 69B. Namely, the controller 130 controls the recording head 38 to jet ink droplets from a part or all of the nozzles 39.

When an image is recorded on the sheet 12, the controller 130 controls the conveyance motor 101 to control the conveyance roller pair 59 and the discharge roller pair 44. This causes the conveyance roller pair 59 and the discharge roller pair 44 to perform intermittent conveyance processing in which conveyance of the sheet 12 by a predefined line feed and a stop of the conveyance of the sheet 12 are performed repeatedly and alternately.

The controller 130 performs the recording processing while the sheet 12 is stopped in the intermittent conveyance processing. In the recording processing, the power feeding to each piezoelectric element 45 is controlled to jet ink droplets from each nozzle 39 during the movement of the carriage 40 in the left-right direction 9. That is, in the recording processing, the controller 130 controls the recording head 38 to jet ink droplets from each nozzle 39 in one pass in which the carriage 40 moves from one end to the other end of a printing range. Accordingly, an image corresponding to one pass (a one-pass image) is recorded on the sheet 12.

Performing the intermittent conveyance processing and the recording processing alternately can record images each corresponding to one pass (one-pass images) in an entire area of the sheet 12 where image recording can be performed.

<Recording Control by Controller 130>

Figure 5:
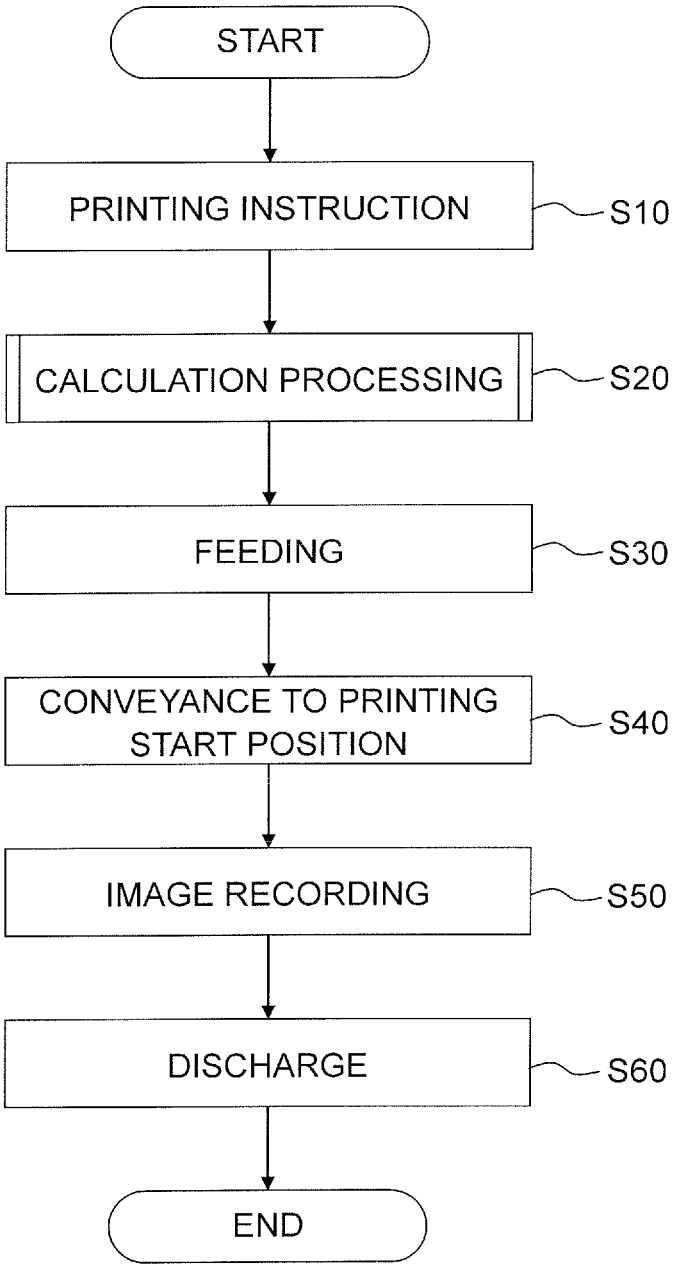
FIG. 5 is a flowchart of illustrating recording control processing.

In the printing unit 11 configured as described above, the recording control, in which the sheet 12 is fed and conveyed and an image based on image data is recorded on the conveyed sheet 12, is performed by the controller 130. The following explains the recording control processing based on the flowchart shown in FIG. 5.

When an instruction for performing printing on the sheet 12 is sent to the controller 130 from the operation unit 17 (see FIG. 1) of the multifunction peripheral 10 or an external device connected to the multifunction peripheral 10 (S10), the controller 130 performs calculation processing (S20). The calculation processing is performed at any timing after the printing instruction is sent to the controller 130 before the image recording is started. For example, the calculation processing may be performed in parallel with feeding (S30) and conveyance (S40) which will be described later.

The calculation processing is processing for calculating an overlap amount. The overlap amount is a length of an overlap area in the conveyance direction 15, the overlap area being configured by an image corresponding to one pass (a one-pass image) recorded on the sheet 12 in a predefined one pass in the recording processing and an image corresponding to one pass (a one-pass image) recorded on the sheet 12 in the next one pass after the predefined one pass in the recording processing.

Here, overlapping the one-pass image recorded on the sheet 12 in the predefined one pass with the one-pass image recorded on the sheet 12 in the next one pass after the predefined one pass means as follows. For example, as depicted in FIG. 12A, ink droplet dots 161 (dots hatched in FIG. 12A) jetted from each nozzle 39 in the predefined one pass are thinned out at an end in the conveyance direction 15, and ink droplet dots 162 (dots that are not hatched in FIG. 12A) jetted from each nozzle 39 in the next pass compensate for the thinned-out dots.

Figure 12A:
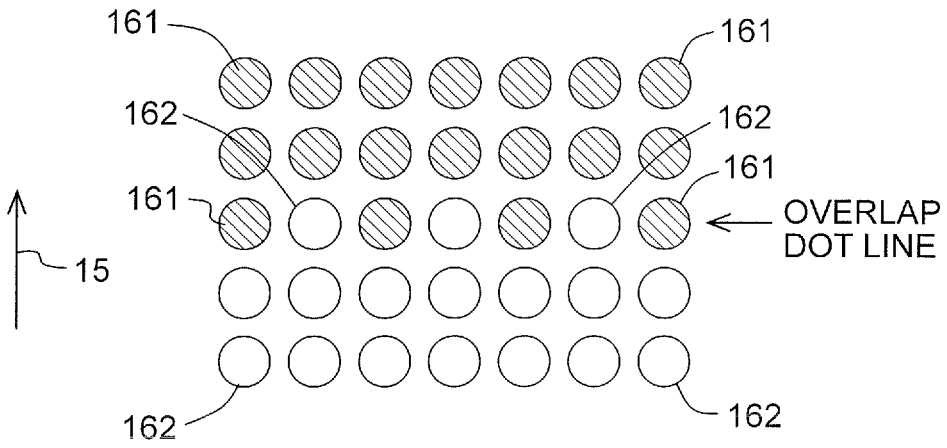
FIGS. 12A and 12B are plan views each schematically depicting some of dots recorded on the sheet in the vicinity of a boundary between a predefined one pass and the next one pass, FIG. 12A depicting an overlap dot line configured by dots of the predefined one pass and dots of the next one pass, FIG. 12B depicting two overlap dot lines configured by dots of the predefined one pass and dots of the next one pass.

FIG. 12A depicts an overlap dot line configured by the one-pass image recorded on the sheet 12 in the predefined one pass and the one-pass image recorded on the sheet 12 in the next one pass after the predefined one pass. In that case, the overlap amount can be calculated by multiplying "1" (indicating the number of overlap dot lines) by a resolution C (a pitch between the nozzles) described later.

Figure 12B:
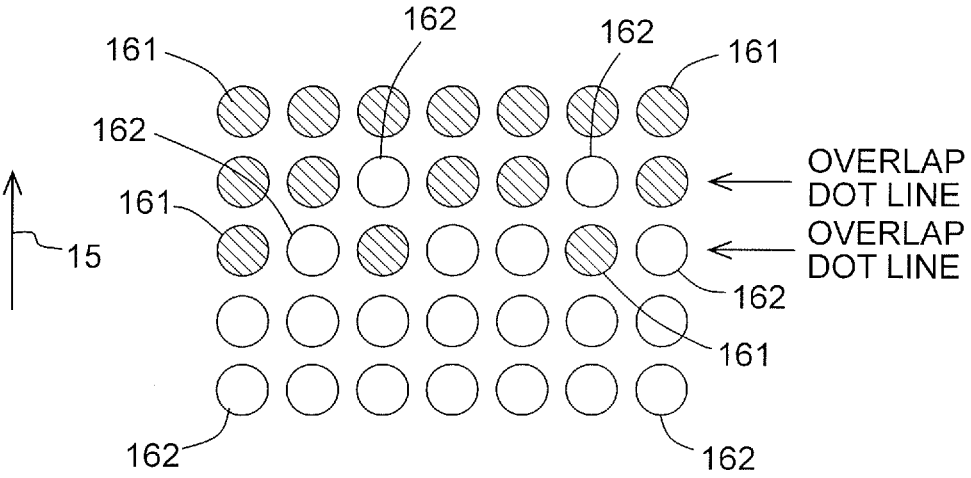

FIG. 12B depicts two overlap dot lines configured by the one-pass image recorded on the sheet 12 in the predefined one pass and the one-pass image recorded on the sheet 12 in the next one pass after the predefined one pass. In that case, the overlap amount can be calculated by multiplying "2" (indicating the number of overlap dot lines) by the resolution C.

Figure 6:
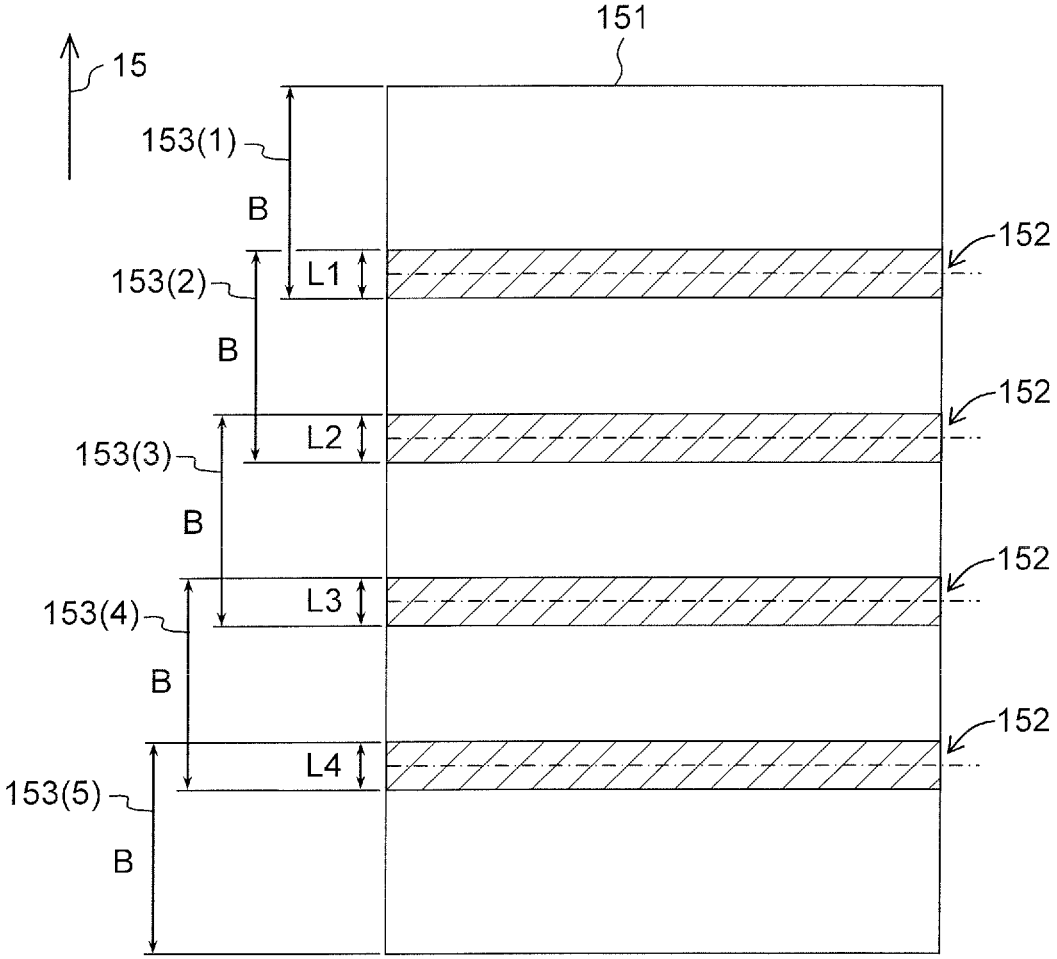
FIG. 6 schematically depicts scanning areas of passes when images are recorded in an image recordable area of a sheet, wherein overlap amounts are uniform.
Figure 7:
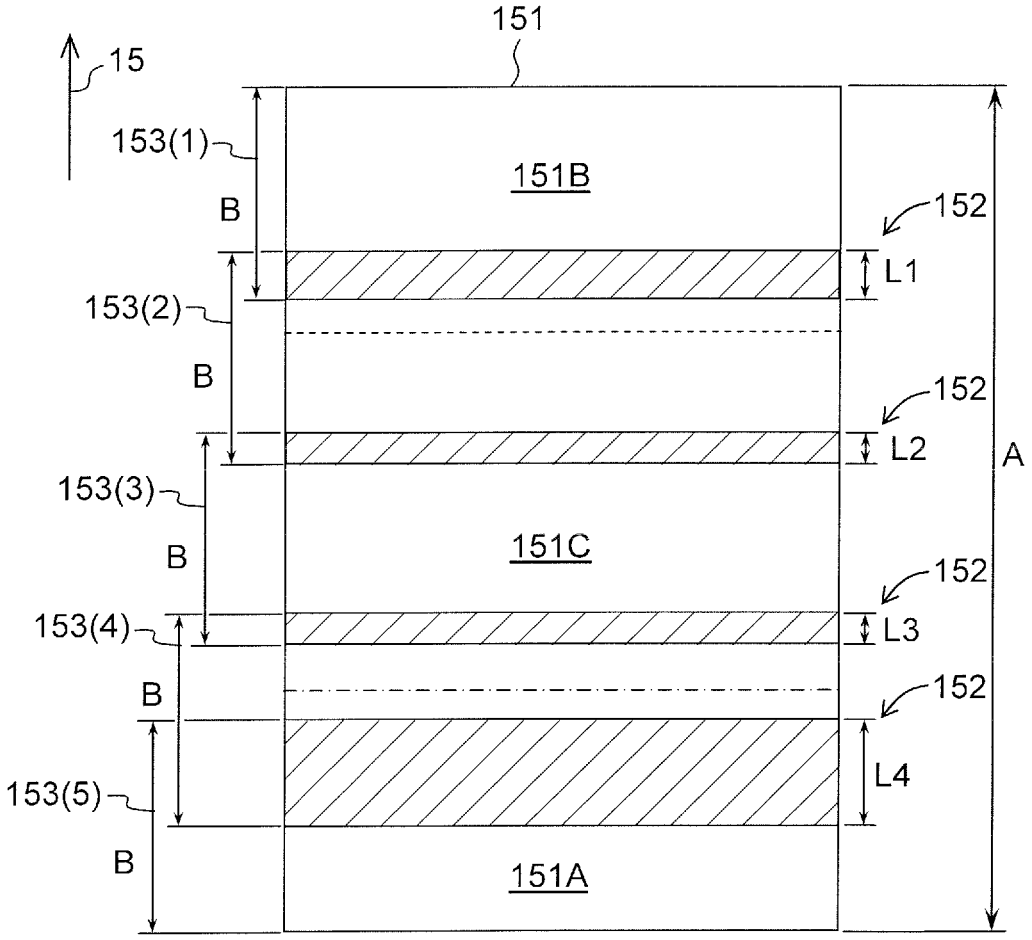
FIG. 7 schematically depicts scanning areas of passes when images are recorded in the image recordable area of the sheet, wherein overlap amounts are different from each other.

FIGS. 6 and 7 each schematically depict scanning areas of respective passes 153 when the passes 153 are executed to record images in an image recordable area 151 of the sheet 12. In FIGS. 6 and 7, the overlap amount of a first pass 153(1) and a second pass 153(2) is an overlap amount L1, the overlap amount of the second pass 153(2) and a third pass 153(3) is an overlap amount L2, the overlap amount of the third pass 153(3) and a fourth pass 153(4) is an overlap amount L3, and the overlap amount of the fourth pass 153(4) and a fifth pass 153(5) is an overlap amount L4.

FIG. 6 schematically depicts a case where the respective overlap amounts are identical. FIG. 7 schematically depicts a case where the respective overlap amounts are calculated corresponding to the respective nipping states in the calculation processing of this embodiment. The calculation processing will be described later in detail.

When receiving a printing instruction, the controller 130 controls the feed roller 25 to feed the sheet 12 supported by the feed tray 20 to the conveyance path 65 (S30). The controller 130 controls the conveyance roller pair 59 to convey the sheet 12 in the conveyance direction 15 until the sheet 12 reaches a printing start position facing the recording unit 24 (S40). The printing start position is a position where the downstream end of the image recordable area of the sheet 12 in the conveyance direction 15 faces nozzles 39, of the nozzles 39, arranged at the most downstream position in the conveyance direction 15.

Then, the controller 130 executes the processing for recording an image on the sheet 12 (S50). In the step S50, the controller 130 records the image on the sheet 12 by alternately executing the intermittent conveyance processing and the recording processing. In that situation, the scanning areas of the respective passes overlap with each other by the respective overlap amounts calculated in the step S20. Performing the intermittent conveyance processing and the recording processing alternately multiple times forms seams 152 on the sheet 12, each seam 152 being a boundary between one-pass images recorded in respective passes. When completing the processing for recording the image on the sheet 12, the controller 130 controls the discharge roller pair 44 to convey the sheet 12 in the conveyance direction 15. This discharges the sheet 12 on the discharge tray 21 (S60).

<Calculation Processing>

The details of the calculation processing executed in the step S20 will be explained with reference to FIGS. 7, 8A and 8B. As described above, the calculation processing is processing for calculating the overlap amount, and the overlap amount may include, for example, lengths indicated by L1, L2, L3, and L4 in FIG. 7.

When a printing instruction is received, image data used for image recording on the sheet 12 is sent to the controller 130. The controller 130 receiving the image data recognizes a length A in the conveyance direction 15 of the image corresponding to the image data to be recorded on the sheet 12. In this embodiment, the length A corresponds to a length in the conveyance direction 15 of an entire area of the sheet 12 where the image recording based on the image data can be performed (specifically, a range of the sheet 12 not including blanks).

The controller 130 calculates (S210) the number of seams 152 (hereinafter referred to as the number of seams m) and the number of passes 153 (hereinafter referred to as the number of passes n) based on the length A and a head length B of the recording head 38.

The head length B is a length in the conveyance direction 15 between the nozzles 39 positioned at the most upstream side in the conveyance direction 15 and the nozzles 39 positioned at the most downstream side in the conveyance direction 15 (see FIG. 3). Namely, the head length B is a length in the conveyance direction 15 of a one-pass image recorded on the sheet 12 in each pass 153.

The seam 152 is a boundary between the predefined one pass and the next one pass. The number of seams m is a whole number part obtained by dividing the length A by the head length B. The number of passes n is calculated by m+1.

For example, when the length A is 173.3 mm and the head length B is 35 mm, the number of seams m is a whole number part of 4.95 . . . , which is obtained by dividing the length A by the head length B. Namely, the number of seams m is four, and the number of passes n is five. FIGS. 6 and 7 each schematically depict scanning areas of the respective passes (the first pass 153(1) to the fifth pass 153(5)) when the number of seams m is four and the number of passes n is five.

Further, the controller 130 recognizes a position in the conveyance direction 15 of each seem 152 on the sheet 12 and a position in the conveyance direction 15 of each pass 153 on the sheet 12, based on the relative positional relation in the conveyance direction 15 between the carriage 40 and the sheet 12 in each pass 153.

Next, the controller 130 calculates a total overlap amount L (S220). The total overlap amount L is calculated by a formula: B×n−A. The total overlap amount L is a total of the overlap amounts that can be distributed to the seams 152.

Next, the controller 130 calculates the total number of overlap dot lines D (S230). The total number of overlap dot lines D is a whole number part obtained by dividing the total overlap amount L by the resolution C. The total number of overlap dot lines D is a total of the overlap dot lines that can be distributed to the seams 152. The resolution C (the pitch between the nozzles) is a distance between the nozzles 39 adjacent to each other in the conveyance direction 15 (see FIG. 3). The resolution C is, for example, 0.085 mm.

Next, in the steps S240 to S320, the controller 130 distributes the total number of overlap dot lines D to each nipping state of the sheet 12 (specifically, each seam 152 positioned in the area of the sheet 12 where the image is recorded in each nipping state). Namely, the controller 130 distributes the total number of overlap dot lines D to the seams 152 as the number of overlap dot lines based on the nipping states of the sheet 12 when the seams 152 are formed. Then, the controller 130 calculates each overlap amount by multiplying the number of overlap dot lines distributed as described above by the resolution C.

Here, each nipping state of the sheet 12 depends on the state in which the sheet 12 is nipped by the conveyance roller pair 59 and/or the discharge roller pair 44 in the next one pass. In this embodiment, the nipping states of the sheet 12 include a first state in which the sheet 12 is nipped by the discharge roller pair 44 and is not nipped by the conveyance roller pair 59; a second state in which the sheet 12 is nipped by the conveyance roller pair 59 and is not nipped by the discharge roller pair 44; and a third state in which the sheet 12 is nipped by the conveyance roller pair 59 and the discharge roller pair 44.

In the first state, an image is recorded at an upstream end of the sheet 12 in the conveyance direction 15 (a rear end of the sheet 12). In the second state, an image is recorded at a downstream end of the sheet 12 in the conveyance direction 15 (a front end of the sheet 12). In the third state, an image is recorded at a center of the sheet 12 in the conveyance direction 15. Namely, the image recordable area 151 of the sheet 12 is configured by three areas including: a rear end 151A in which an image is recorded in the first state (in FIG. 7, an area upstream of a dot-dash chain line in the conveyance direction 15); a front end 151B in which an image is recorded in the second state (in FIG. 7, an area downstream of a broken line in the conveyance direction 15); and a center area 151C in which an image is recorded in the third state (in FIG. 7, an area between the dot-dash chain line and the broken line in the conveyance direction 15).

In FIG. 7, the single seam 152 is in the rear end 151A, the single seam 152 is in the front end 151B, and the two seams 152 are in the center area 151C.

Each of the first state, the second state, and the third state has the order of priority for determination of the distribution of the total number of overlap dot lines D. The first state has the highest priority, the second state has the second highest priority, and the third state has the lowest priority. The controller 130 distributes the total number of overlap dot lines D to the first state, the second state, and the third state in that order. Namely, the order of priority is set to the nipping states, and the controller 130 distributes the total number of overlap dot lines D preferentially to the seam 152 formed in the nipping state having the higher priority. The order of priority (priority order) may be stored in the ROM 132 or the EEPROM 134.

The following explains details of the steps S240 to S320.

First, the controller 130 determines whether the seam 152 is in the rear end 151A of the sheet 12 (S240).

It is assumed that each seam 152 in the step S240 and steps S270 and S300 described later is in a center position of each overlap amount when the overlap amounts are identical. Namely, it is assumed that each seam 152 in the steps S240, S270, and S300 is in a position in the conveyance direction 15 indicated by the dot-dash chain line in FIG. 6.

As described above, the rear end 151A of the sheet 12 is an area in which an image is recorded on the sheet 12 having the first state.

When the seam 152 is in the rear end 151A of the sheet 12 (S240: Yes), the controller 130 determines whether the total number of overlap dot lines D is zero (S250). When the total number of overlap dot lines D is zero (S250: No), the total number of overlap dot lines D that can be distributed to the seam 152 in the rear end 151A of the sheet 12 does not exist. Thus, "0" is calculated as the overlap amount for the rear end 151A of the sheet 12. When the total number of overlap dot lines D that can be distributed to the seam 152 in the rear end 151A of the sheet 12 does not exist, the total number of overlap dot lines D that can be distributed to the seam 152 in the front end 151B of the sheet 12 and the seam 152 in the center area 151C of the sheet 12 does not exist as well. Thus, "0" is calculated as the overlap amount C for the front end 151B of the sheet 12 and "0" is calculated as the overlap amount for the center area 151C of the sheet 12. Then, the calculation processing ends.

When the total number of overlap dot lines D is not zero (S250: Yes), the controller 130 distributes the total number of overlap dot lines D to the seam 152 in the rear end 151A of the sheet 12 (S260). When the seams 152 are in the rear end 151A of the sheet 12, the total number of overlap dot lines D is distributed to each seam 152. Here, a threshold value of the number of overlap dot lines in the rear end PB (hereinafter simply referred to as the threshold value PB) is set as the maximum number of dot lines to be distributed to each seam 152 in the rear end 151A of the sheet 12. Thus, the total number of overlap dot lines D that is larger than the threshold value PB is not distributed to each seam 152 in the rear end 151A of the sheet 12.

When the total number of overlap dot lines D is less than the threshold value PB in a state where the single seam 152 is in the rear end 151A of the sheet 12, the total number of overlap dot lines D is entirely distributed to the single seam 152. When the total number of overlap dot lines D is less than a value obtained by multiplying the threshold value PB by the number of seams 152 in a state where the seams 152 are in the rear end 151A of the sheet 12, all the total number of overlap dot lines D may be distributed uniformly to each seam 152 or all the total number of overlap dot lines D may be distributed preferentially to a predefined seam 152 (e.g., a seam 152 closer to the rear end of the sheet 12). A fraction that may be caused when the total number of overlap dot lines D is distributed uniformly may not be distributed or may be distributed to the predefined seam 152.

When the distribution of the total number of overlap dot lines D in the step S260 has been completed or no seam 152 is in the rear end 151A of the sheet 12 in the step S240 (S240: No), the controller 130 determines whether the seam 152 is in the front end 151B of the sheet 12 (S270). Here, the front end 151B of the sheet 12 is an area in which an image is to be recorded on the sheet 12 having the second state.

When the seam 152 is in the front end 151B of the sheet 12 (S270: Yes), the controller 130 determines whether the remaining total number of overlap dot lines D is zero (S280). When the remaining total number of overlap dot lines D is zero (S280: No), the total number of overlap dot lines D that can be distributed to the seam 152 in the front end 151B of the sheet 12 does not exist. Thus, "0" is calculated as the overlap amount for the front end 151B of the sheet 12. When the total number of overlap dot lines D that can be distributed to the seam 152 in the front end 151B of the sheet 12 does not exist, the total number of overlap dot lines D that can be distributed to the seam 152 in the center area 151C of the sheet 12 do not exist as well. Thus, "0" is calculated as the overlap amount for the center area 151C of the sheet 12. Then, the calculation processing ends.

When the remaining total number of overlap dot lines D is not zero (S280: Yes), the controller 130 distributes the remaining total number of overlap dot lines D to the seam 152 in the front end 151B of the sheet 12 (S290). When the seams 152 are in the front end 151B of the sheet 12, the remaining total number of overlap dot liens D is distributed to each seam 152. Here, a threshold value of the number of overlap dot lines in the front end PF (hereinafter simply referred to as the threshold value PF) is set as the maximum number of dot lines to be distributed to each seam 152 in the front end 151B of the sheet 12. Thus, the remaining total number of overlap dot lines D that is larger than the threshold value PF is not distributed to each seam 152 in the front end 151B of the sheet 12.

When the remaining total number of overlap dot lines D is less than the threshold value PF in a state where the single seam 152 is in the front end 151B of the sheet 12, the remaining total number of overlap dot lines D is entirely distributed to the single seam 152. When the total number of overlap dot lines D is less than a value obtained by multiplying the threshold value PF by the number of seams 152 in a state where the seams 152 are in the front end 151B of the sheet 12, all the remaining total number of overlap dot lines D may be distributed uniformly to each seam 152 or all the remaining total number of overlap dot lines D may be distributed preferentially to a predefined seam 152 (e.g., a seam 152 closer to the front end of the sheet 12). A fraction that may be caused when the remaining total number of overlap dot lines D is distributed uniformly may not be distributed or may be distributed to the predefined seam 152.

When the distribution of the total number of overlap dot lines D in the step S290 has been completed or no seam 152 is in the front end 151B of the sheet 12 in the step S270 (S270: No), the controller 130 determines whether the seam 152 is in the center area 151C of the sheet 12 (S300). Here, the center area 151C of the sheet 12 is an area in which an image is to be recorded on the sheet 12 having the third state.

When no seam 152 is in the center area 151C of the sheet 12 (S300: No), no overlap amount for the center area 151C of the sheet 12 is calculated, and the calculation processing ends.

When the seam 152 is in the center area 151C of the sheet 12 (S300: Yes), the controller 130 determines whether the remaining total number of overlap dot lines D is zero (S310). When the remaining total number of overlap dot lines D is zero (S310: No), the total number of overlap dot lines D that can be distributed to the seam 152 in the center area 151C of the sheet 12 do not exist. Thus, "0" is calculated as the overlap amount for the center area 151C of the sheet 12. Then, the calculation processing ends.

When the remaining total number of overlap dot lines D is not zero (S310: Yes), the controller 130 distributes the remaining total number of overlap dot lines D to the seam 152 in the center area 151C of the sheet 12 (S320). When the seams 152 are in the center area 151C of the sheet 12, the remaining total number of overlap dot lines D is distributed to each seam 152. Here, a threshold value of the number of overlap dot lines in the center area PC (hereinafter simply referred to as the threshold value PC) is set as the maximum number of dot lines to be distributed to each seam 152 in the center area 151C of the sheet 12. Thus, the remaining total number of overlap dot lines D that is larger than the threshold value PC is not distributed to each seam 152 in the center area 151C of the sheet 12.

When the remaining total number of overlap dot lines D is less than the threshold value PC in a state where the single seam 152 is in the center area 151C of the sheet 12, the remaining total number of overlap dot lines D is entirely distributed to the single seam 152. When the total number of overlap dot lines D is less than a value obtained by multiplying the threshold value PC by the number of seams 152 in a state where the seams 152 are in the center area 151C of the sheet 12, all the remaining total number of overlap dot lines D may be distributed uniformly to each seam 152 or all the remaining total number of overlap dot lines D may be distributed preferentially to a predefined seam 152 (e.g., a seam 152 closer to the front or rear end of the sheet 12). A fraction that may be caused when the remaining total number of overlap dot lines D is distributed uniformly may not be distributed or may be distributed to the predefined seam 152.

Finally, the controller 130 calculates the overlap amount distributed to each seam 152 by multiplying the number of overlap dot lines distributed to each seam 152 by the resolution C, as described above.

In the calculation processing, the overlap amount is calculated based on the length A in the conveyance direction 15 of the image which corresponds to image data and which is to be recorded on the sheet 12 and the length B in the conveyance direction 15 of the nozzle area including the nozzles 39. The overlap amount depends on each nipping state, of the sheet 12 for which a one-pass image is to be recorded in the next one pass, by use of the conveyance roller pair 59 and the discharge roller pair 44, In this embodiment, the threshold value PB is set to be larger than the threshold value PF. The threshold value PF is set to be larger than the threshold value PC.

Thus, in the calculation processing, the controller 130 distributes each overlap amount so that the overlap amount (a first overlap amount) corresponding to the state (the first state) in which the sheet 12, for which the one-pass image is to be recorded in the next one pass, is nipped by the discharge roller pair 44 and is not nipped by the conveyance roller pair 59 is larger than the overlap amount (a second overlap amount and a third overlap amount) corresponding to the state (the second state and the third state) in which the sheet 12, for which the one-pass image is to be recorded in the next one pass, is nipped by the conveyance roller pair 59. Namely, in FIG. 7, the overlap amount L4 is larger than the overlap amounts L1, L2, and L3.

Further, in the calculation processing, the controller 130 distributes each overlap amount so that the overlap amount (a second overlap amount) corresponding to the state (the second state) in which the sheet 12, for which the one-pass image is to be recorded in the next one pass, is nipped by the conveyance roller pair 59 and is not nipped by the discharge roller pair 44 is larger than the overlap amount (a third overlap amount) corresponding to the state (the third state) in which the sheet 12, for which the one-pass image is to be recorded in the next one pass, is nipped by the conveyance roller pair 59 and the discharge roller pair 44. Namely, in FIG. 7, the overlap amount L1 is larger than the overlap amounts L2 and L3.

In this embodiment, the overlap amount depends on each of the nipping states (each of the first, second, and third states). Namely, the overlap amount L4 in the first state, the overlap amount L1 in the second state, the overlap amounts L2 and L3 in the third state are mutually different from each other. However, it is not indispensable to vary the overlap amounts depending on mutually different nipping states. For example, the overlap amount L4 in the first state may be equal to the overlap amount L1 in the second state, and the overlap amounts L2 and L3 in the third state may be smaller than the overlap amounts L1 and L4.

As described above, the overlap amounts calculated by the controller 130 include "0".

The controller 130 may perform the intermittent conveyance of the sheet 12 and recording of the one-pass image on the sheet alternately multiple times to form seams 152 on the sheet 12, each of the seams 152 being a boundary between the one-pass image formed in the predefined one pass and the one-pass image formed in the next one pass; calculate the number of passes n, the number of the seams m, and a total overlap amount L which are required to record the image corresponding to the image data, based on the length A in the conveyance direction 15 of the image corresponding to the image data to be recorded on the sheet and the length B of the nozzle area in the conveyance direction 15; determine whether a first seam corresponding to the first state is to be formed, whether a second seam corresponding to the second state is to be formed, and whether a third seam corresponding to the third state is to be formed; and distribute the total overlap amount L to the seams 152 as the overlap amounts, based on the nipping states of the sheet 15 in cases of forming the seams 152. Further, in the calculation processing of this embodiment, the controller 130 assigns the first overlap amount L4 included in the total overlap amount to the first seam when the first seam is to be formed, assigns the second overlap amount L1 included in the total overlap amount to the second seam when the second seam is to be formed, and assigns the third overlap amounts L2 and L3 included in the total overlap amount to the third seam when the third seam is to be formed. The assignments of the first overlap amount, the second overlap amount and the third overlap amount may be performed in that order. The first overlap amount L4 may be larger than the second overlap amount L1, and the second overlap amount L1 may be larger than the third overlap amounts L2 and L3.

EFFECTS OF EMBODIMENT

The variation in the conveyance mount of the sheet 12 depends on each nipping state of the sheet 12. In the above embodiment, lengthening the length in the conveyance direction 15 of the overlap amount corresponding to the nipping state where the conveyance amount of the sheet 12 varies greatly can reduce a white streak or stripe that may occur at a boundary between one-pass images recorded in respective passes.

Shortening the length in the conveyance direction 15 of the overlap amount corresponding to the nipping state where the conveyance amount of the sheet 12 hardly varies can reduce a total length in the conveyance direction 15 of a total overlap amount of the sheet 12 (L1+L2+L3+L4). This eliminates the necessity of increasing the number of passes to form each overlap amount, thus reducing the possibility of decreasing the speed of image recording on the sheet 12.

In the above embodiment, the total overlap amount L is distributed preferentially to a nipping state with a higher priority. Thus, even when the total overlap amount L is smaller than a threshold value of the number of overlap dot lines corresponding to a nipping state with a higher priority, the one-pass image to be recorded on the sheet 12 in the predefined one pass is reliably overlapped with the one-pass image to be recorded on the sheet 12 in the next one pass after the predefined one pass, in the nipping state of the sheet 12 with the higher priority. This can reduce occurrence of the white streak in the nipping state having the higher priority.

For example, even when the total overlap amount L is smaller than the threshold value PB in the first state, the one-pass image to be recorded on the sheet 12 in the predefined one pass is reliably overlapped with the one-pass image to be recorded on the sheet 12 in the next one pass after the predefined one pass, in the first state.

For example, even when the total overlap amount L is larger than the threshold value PB in the first state and smaller than the total of the threshold value PB in the first state and the threshold value PF in the second state, the one-pass image to be recorded on the sheet 12 in the predefined one pass is reliably overlapped with the one-pass image to be recorded on the sheet 12 in the next one pass after the predefined one pass, in the first and second states.

The discharge roller pair 44 is positioned downstream of the recording head 38 in the conveyance direction 15. Namely, the discharge roller pair 44 nips the sheet 12 after image recording. Thus, the force nipping the sheet 12 by the discharge roller pair 44 is smaller than the force nipping the sheet 12 by the conveyance roller pair 59. Further, a contact area of the discharge roller pair 44 and the sheet 12 nipped by the discharge roller pair 44 is smaller than a contact area of the conveyance roller pair 59 and the sheet 12 nipped by the conveyance roller pair 59. Thus, the variation in the conveyance amount of the sheet 12 in the state (the first state) where the sheet 12 is nipped by the discharge roller pair 44 and is not nipped by the conveyance roller pair 59 is larger than the variation in the conveyance amount of the sheet 12 in the states (the second and third states) where the sheet 12 is nipped by the conveyance roller pair 59. In the above embodiment, a larger overlap amount is distributed as the variation in the conveyance amount of the sheet 12 is larger. This reduces occurrence of the white streak which may be formed at a boundary between one-pass images recorded in respective passes, even when the conveyance amount of the sheet 12 varies greatly.

Further, the variation in the conveyance amount of the sheet 12 in the state (the second state) where the sheet 12 is nipped by the conveyance roller pair 59 and is not nipped by the discharge roller pair 44 is larger than the variation in the conveyance mount of the sheet 12 in the state (the third state) where the sheet 12 is nipped by the conveyance roller pair 59 and the discharge roller pair 44. In the above embodiment, a larger overlap amount is distributed as the variation in the conveyance amount of the sheet 12 is larger. This reduces occurrence of the white streak which may be formed at a boundary between one-pass images recorded in respective passes, even when the conveyance amount of the sheet 12 varies greatly.

First Modified Embodiment

In the above embodiment, the controller 130 converts the total overlap amount L to the total number of overlap dot lines D in the calculation processing, and then distributes the total number of overlap dot lines D to the nipping states (the first, second, and third states) in accordance with the order of priority. The distribution of the total overlap amount L by the controller 130, however, is not limited thereto.

For example, the controller 130 may convert the total overlap amount L to the total number of overlap dot lines D in the calculation processing, may distribute a part of the total number of overlap dot lines D to the first state and the second state in accordance with the order of priority, and then may distribute all the remaining total number of overlap dot lines D uniformly to the first, second, and third states. Namely, in the calculation processing, the controller 130 may distribute a predefined amount of the total overlap amount L uniformly to all the nipping states.

Figure 8A:
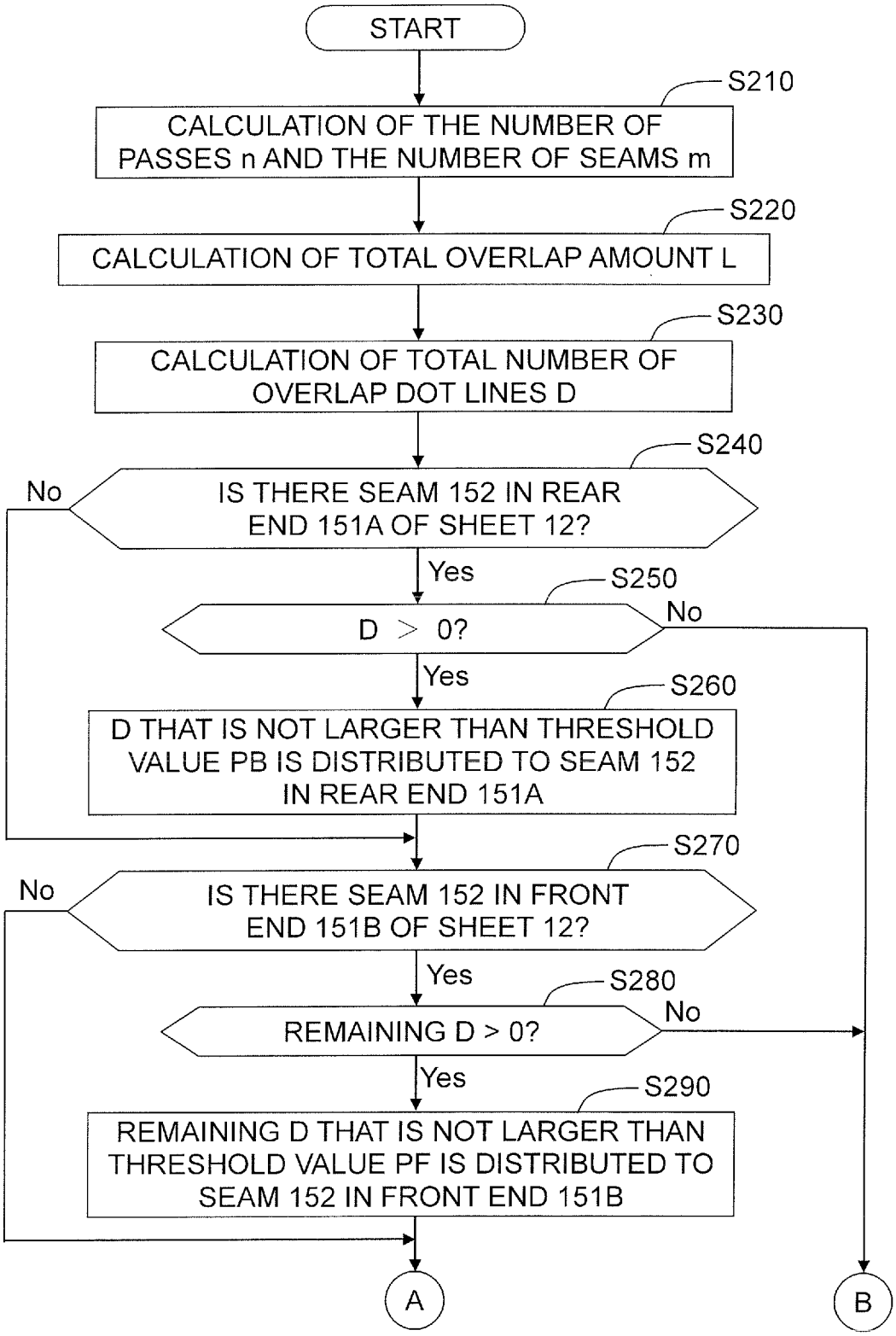
FIGS. 8A and 8B are flowcharts of illustrating calculation processing.
Figure 9A:
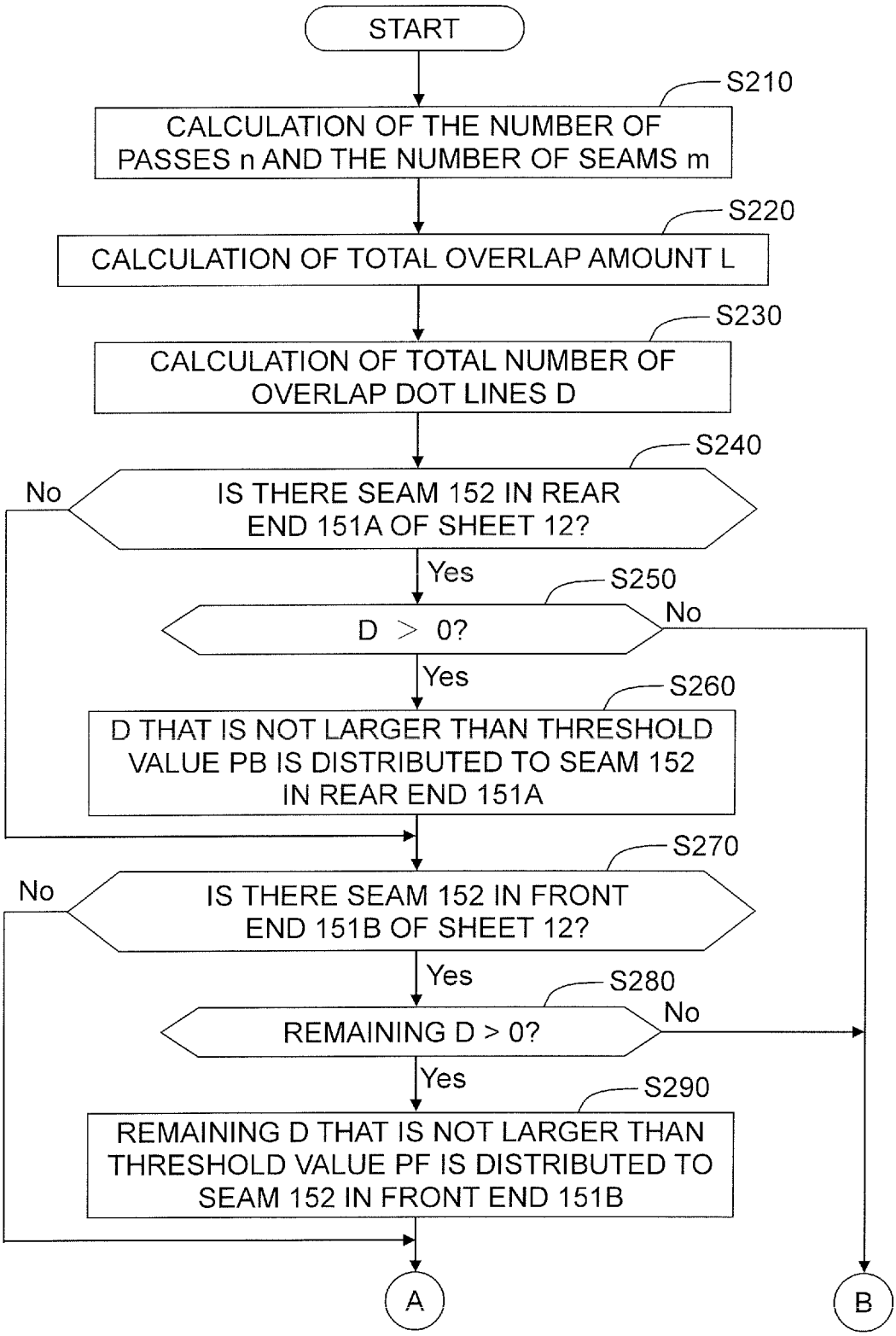
FIGS. 9A and 9B are flowcharts of illustrating calculation processing of a first modified embodiment.
Figure 9B:
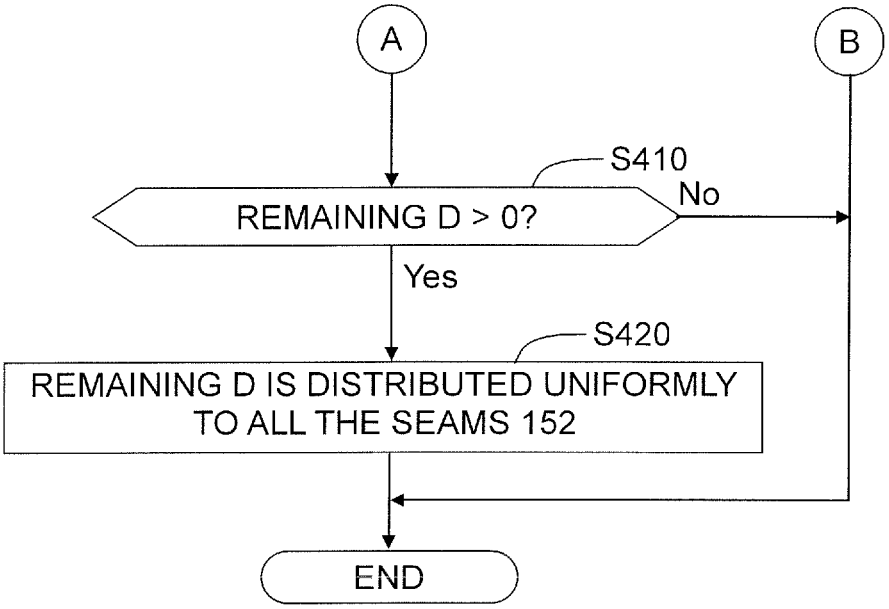

FIGS. 9A and 9B are flowcharts indicating such processing. In FIG. 9A, the processing in which the total number of overlap dot lines D is distributed to the first state and the second state, that is, the processing from the step S210 to the step S290 is the same as the flowchart for the above embodiment shown in FIG. 8A.

After the step S290, when the remaining total number of overlap dot lines D is not zero (S410: Yes), the controller 130 distributes the remaining total number of overlap dot lines D uniformly to the seams 152 in the rear end 151A, the front end 151B, and the center area 151C of the sheet 12, that is, all the seams 152 (S420).

In this modified embodiment, in the step S410, the threshold values PB and PF are adjusted so that the remaining total number of overlap dot lines D is not zero (S400: No). Thus, in this modified embodiment, the processing in the step S420 is indispensable.

In the step S420, when a fraction prevents the remaining total number of overlap dot lines D from being distributed uniformly to all the seams 152, the fraction may not be distributed or may be distributed to each seam 152 in accordance with a predefined order of priority (e.g., in the order of the first state, the second state, and the third state).

In the first modified embodiment, the overlap amount can be distributed to all the boundaries between one-pass images to be recorded on the sheet 12 in the predefined one pass and one-pass images to be recorded on the sheet 12 in the next one pass after the predefined one pass. At a boundary to which no overlap amount is distributed, a small variation in the conveyance amount of the sheet 12 causes the white streak. In the first modified embodiment, however, there is no boundary to which no overlap amount is distributed, thus preventing occurrence of the white streak.

Second Modified Embodiment

In the above embodiment and the first modified embodiment, the controller 130 converts the total overlap amount L to the total number of overlap dot lines D in the calculation processing, and then distributes the total number of overlap dot lines D to the rear end 151A, the front end 151B, and the center area 151C in that order.

The controller 130, however, may distribute the total overlap amount L to the respective nipping states based on a data table stored in the ROM 132 or the EEPROM 134, in the calculation processing. Namely, in the calculating processing, the controller 130 may calculate the overlap amount to be distributed to each seam 152 based on the total overlap amount L and the data table.

As indicated in FIG. 10, in the data table, a distribution proportion of the total overlap amount is set for each nipping state. Namely, the distribution proportion of the total overlap amount in the first state is K1 (%), the distribution proportion of the total overlap amount in the second state is K2 (%), and the distribution proportion of the total overlap amount in the third state is K3 (%). In the second modified embodiment, the distribution proportion of the total overlap amount in the first state is the largest, the distribution proportion of the total overlap amount in the second state is the second largest, the distribution proportion of the total overlap amount in the third state is the smallest. For example, the distribution proportions are as follows: K1=50 (%), K2=30(%), and K3=20(%). Each of the ROM 132 and the EEPROM 134 storing the data table is an exemplary storage unit (a memory). In FIG. 10, K1+K2+K3=100(%) is satisfied.

The following explains an example of the distribution of the total overlap amount L by use of the data table.

At first, the controller 130 executes the steps S210 to S230 of the flowchart shown in FIG. 8A to calculate the number of passes n, the number of seams m, the total overlap amount L, and the total number of overlap dot lines D.

Then, the controller 130 calculates the number of seams m1 in the rear end 151A, the number of seams m2 in the front end 151B, and the number of seams m3 in the center area 151C, based on the position of each seam 152 on the sheet 12 in the conveyance direction 15. The equation m1+m2+m3=m is satisfied.

Next, the controller 130 calculates the number of overlap dot lines per unit d. The number of overlap dot lines per unit d is a whole number part obtained by dividing the total number of overlap dot lines D by a total proportion value R. The total proportion value R is calculated by the relation (K1×m1+K2×m2+K3×m3)/100.

Next, the controller 130 calculates an overlap amount LA of each seam 152 in the first state, an overlap amount LB of each seam 152 in the second state, and an overlap amount LC of each seam 152 in the third state. The overlap amount LA is calculated by the relation (d×K1×C)/100. The overlap amount LB is calculated by the relation (d×K2×C)/100. The overlap amount LC is calculated by the relation (d×K3×C)/100. Namely, the overlap amount LA is obtained by multiplying a whole number part of a product of d and (K1/100) by resolution C. The overlap amount LB is obtained by multiplying a whole number part of a product of d and (K2/100) by resolution C. The overlap amount LC is obtained by multiplying a whole number part of a product of d and (K3/100) by resolution C.

The calculation results are as follows: in the rear end 151A, the number of seams 152 corresponding to the overlap amount LA is m1; in the front end 151B, the number of seams 152 corresponding to the overlap amount LB is m2; and in the center area 151C, the number of seams 152 corresponding to the overlap amount LC is m3.

In the above calculation, a reminder obtained by dividing the total number of overlap dot lines D by the total proportion value R in the calculation of the number of overlap dot lines per unit d (i.e., D−R×d) is a fraction of the number of overlap dot lines. Similar to the above embodiment and the first modified embodiment, the number of overlap dot lines corresponding to the fraction may not be distributed to each seam 152 or may be distributed to each seam 152 in accordance with a predefined order of priority.

In the second modified embodiment, the one-pass image to be recorded on the sheet 12 in the predefined one pass is overlapped largely with the one-pass image to be recorded on the sheet 12 in the next one pass after the predefined one pass, in a nipping state having a great distribution proportion. This reduces occurrence of the white streak which may be formed at a boundary between one-pass images recorded in respective passes in the nipping state having the high distribution proportion.

Third Modified Embodiment

In the above embodiment, the length A is a length in the conveyance direction 15 of an entire area of the sheet 12 for which image recording based on image data can be performed, (specifically, a range in the sheet 12 not including blanks). The controller 130 calculates the overlap amount based on the length A in the calculation processing.

In the third modified embodiment, when images are recorded based on image data on multiple areas of the sheet 12 at intervals in the conveyance direction 15 corresponding to a predefined value I or more, the controller 130 may calculate the overlap amount for each image in the calculation processing. Namely, when the image data includes two pieces of partial image data corresponding to two pieces of partial image to be recorded on the sheet 12, and an interval, in the conveyance direction 15, between the two pieces of partial image is not less than a predefined value I, the controller 130 may calculate each of the overlap amounts for each of the two pieces of partial image data. The predefined value I is the length of the nozzle area in the conveyance direction, namely, the head length B. The predefined value I, however, is not limited to the head length B.

Figure 11:
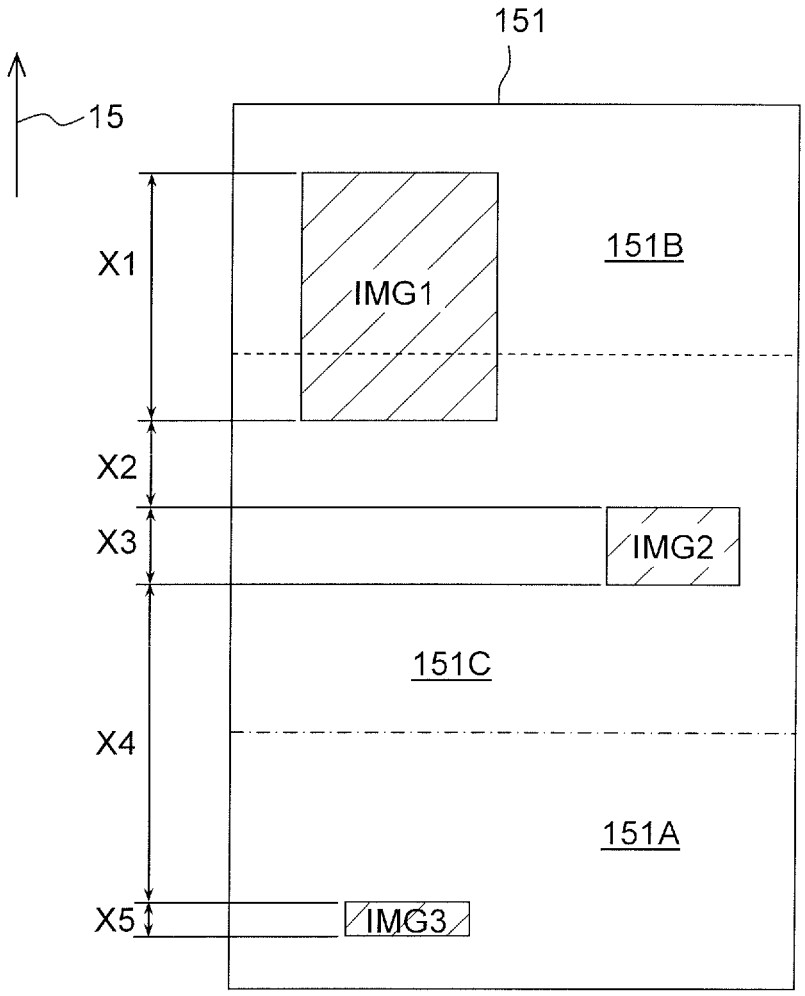
FIG. 11 is a plan view schematically depicting the sheet having images recorded thereon.

For example, as depicted in FIG. 11, when the overlap amount is calculated based on image data with which images IMG1, IMG2, and IMB3 are to be recorded at three portions of the sheet 12, the controller 130 determines whether the IMG1, IMG2, and IMG3 are regarded as one image or they are regarded as different images, by comparing the intervals between the IMG 1 and IMG2 and IMG3 in the conveyance direction 15 to the predefined value I.

In FIG. 11, an interval X2 between the image IMG 1 and the image IMG2 is less than the predefined value I. An interval X4 between the image IMG2 and the image IMG 3 is not less than the predefined value I. Thus, in FIG. 11, the controller 130 determines the images IMG1 and IMG2 as one image in which the length A in the conveyance direction 15 is X1+X2+X3, and determines the image IMG3 as one image in which the length A in the conveyance direction 15 is X5. Then, the controller 130 calculates the overlap amount for each of the two images.

Figure 8B:
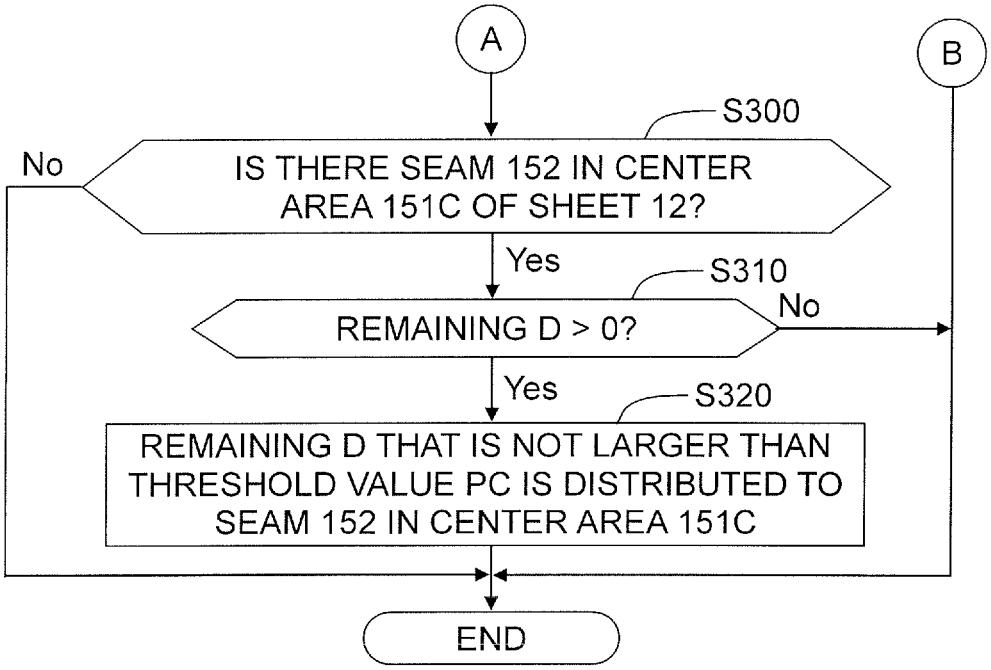

For example, the processing indicated in the flowchart of FIGS. 8A and 8B is executed on each of the two images to calculate each overlap amount. In FIG. 11, the image configured by the images IMB1 and IMG2 may include the seams 152 in the front end 151B and the center area 151C. The image configured by the image IMG3 may include the seam 152 in the rear end 151A. It is needless to say that no seam 152 may be formed in each of the two images depending on the positions of the two images and the lengths in the conveyance direction 15 of the two images.

No images are required to be overlapped with each other in portions of the sheet 12 having no image data. In the third modified embodiment, a portion corresponding to an interval, which is not less than the predefined value I, between images based on the image data, namely, a portion having no image data, is not included in the calculation of the overlap amount. This prevents the overlap amount from being set in a portion where no images are required to be overlapped with each other.

What is claimed is:

1. An ink-jet recording apparatus configured to record an image based on image data on a sheet, the ink-jet recording apparatus comprising:

a first roller pair configured to convey the sheet in a conveyance direction while nipping the sheet;

a recording head disposed downstream of the first roller pair in the conveyance direction, having a nozzle surface in which nozzles are formed in a nozzle area, and configured to jet ink droplets from the nozzles to the sheet;

a carriage carrying the recording head and configured to move in a width direction intersecting with the conveyance direction;

a second roller pair disposed downstream of the recording head in the conveyance direction and configured to convey the sheet in the conveyance direction while nipping the sheet; and a controller configured to:

control the first roller pair and the second roller pair to perform intermittent conveyance of the sheet;

control the carriage and the recording head to record a one-pass image on the sheet by causing the recording head to jet the ink droplets during movement of the carriage in the width direction in a state where the sheet is stopped in the intermittent conveyance of the sheet; and calculate an overlap amount, in the conveyance direction, of a one-pass image to be recorded on the sheet in a predefined one pass and a one-pass image to be recorded on the sheet in a next one pass after the predefined one pass, the overlap amount depending on a nipping state of the sheet by the first roller pair and the second roller pair in a case of recording the one-pass image in the next one pass, wherein the controller is configured to calculate the overlap amount based on a length of the nozzle area in the conveyance direction and a length in the conveyance direction of the image which corresponds to the image data and which is to be recorded on the sheet.

2. The ink-jet recording apparatus according to claim 1, wherein the overlap amount is one of overlap amounts corresponding to different nipping states of the sheet, and the controller is configured to:

perform the intermittent conveyance of the sheet and recording of the one-pass image on the sheet alternately multiple times to form seams on the sheet, each of the seams being a boundary between the one-pass image formed in the predefined one pass and the one-pass image formed in the next one pass, calculate a total overlap amount based on the length of the nozzle area in the conveyance direction and the length in the conveyance direction of the image which corresponds to the image data and which is to be recorded on the sheet, and distribute the total overlap amount to the seams as the overlap amounts based on the nipping states of the sheet in cases of forming the seams.

3. The ink-jet recording apparatus according to claim 2, wherein a priority order is set to the nipping states, and the controller is configured to distribute the total overlap amount preferentially to each of the seams to be formed in a nipping state having a higher priority.

4. The ink-jet recording apparatus according to claim 2, wherein the controller is configured to further distribute a predefined amount of the total overlap amount equally to all of the seams.

5. The ink-jet recording apparatus according to claim 2, further comprising a memory storing a data table in which a distribution proportion of the total overlap amount corresponding to each of the nipping states is set, wherein the controller is configured to calculate the overlap amounts to be distributed to the seams based on the total overlap amount and the distribution proportion set in the data table.

6. The ink-jet recording apparatus according to claim 2, wherein the nipping states of the sheet include a first state in which the sheet is nipped by the second roller pair and is not nipped by the first roller pair, a second state in which the sheet is nipped by the first roller pair and is not nipped by the second roller pair, and a third state in which the sheet is nipped by the first roller pair and the second roller pair.

7. The ink-jet recording apparatus according to claim 6, wherein the controller is configured to calculate a first overlap amount corresponding to the first state to be larger than a second overlap amount corresponding to the second state and a third overlap amount corresponding to the third state.

8. The ink-jet recording apparatus according to claim 6, wherein the controller is configured to calculate a second overlap amount corresponding to the second state to be larger than a third overlap amount corresponding to the third state.

9. The ink-jet recording apparatus according to claim 1, wherein the image data includes two pieces of partial image data corresponding to two pieces of partial image to be recorded on the sheet, an interval, in the conveyance direction, between the two pieces of partial image is not less than a predefined value, and the controller is configured to calculate each of the overlap amounts for each of the two pieces of partial image data.

10. The ink-jet recording apparatus according to claim 9, wherein the predefined value is a length of the nozzle area in the conveyance direction.

11. The ink-jet recording apparatus according to claim 1, wherein the overlap amount is one of overlap amounts corresponding to different nipping states of the sheet, the nipping states of the sheet including a first state in which the sheet is nipped by the second roller pair and is not nipped by the first roller pair, a second state in which the sheet is nipped by the first roller pair and is not nipped by the second roller pair, and a third state in which the sheet is nipped by the first roller pair and the second roller pair, and the controller is configured to:

perform the intermittent conveyance of the sheet and recording of the one-pass image on the sheet alternately multiple times to form seams on the sheet, each of the seams being a boundary between the one-pass image formed in the predefined one pass and the one-pass image formed in the next one pass;

calculate the number of passes, the number of the seams, and a total overlap amount which are required to record the image corresponding to the image data, based on the length of the nozzle area in the conveyance direction and the length in the conveyance direction of the image which corresponds to the image data and which is to be recorded on the sheet;

determine whether a first seam corresponding to the first state is to be formed, whether a second seam corresponding to the second state is to be formed, and whether a third seam corresponding to the third state is to be formed; and distribute the total overlap amount to the seams as the overlap amounts based on the nipping states of the sheet in cases of forming the seams.

12. The ink-jet recording apparatus according to claim 11, wherein the controller is configured to:

assign a first overlap amount included in the total overlap amount to the first seam, in a case that the first seam is to be formed;

assign a second overlap amount included in the total overlap amount to the second seam, in a case that the second seam is to be formed;

assign a third overlap amount included in the total overlap amount to the third seam, in a case that the third seam is to be formed; and perform assignments of the first overlap amount, the second overlap amount and the third overlap amount in that order.

13. The ink-jet recording apparatus according to claim 12, wherein the first overlap amount is larger than the second overlap amount and the second overlap amount is larger than the third overlap amount.

* * * * *